US005289196A

United States Patent [19]

Gans et al.

[11] Patent Number: 5,289,196

[45] Date of Patent: Feb. 22, 1994

[54] SPACE DUPLEXED BEAMSHAPED MICROSTRIP ANTENNA SYSTEM

[75] Inventors: Lawrence S. Gans, Sparta; Leonard Schwartz, Montville, both of N.J.

[73] Assignee: GEC-Marconi Electronic Systems Corp., Wayne, N.J.

[21] Appl. No.: 980,270

[22] Filed: Nov. 23, 1992

[51] Int. Cl.[5] ..... H01Q 1/38; H01Q 11/02

[52] U.S. Cl. ..... 343/700 MS; 343/853; 343/737

[58] Field of Search ..... 343/700 MS, 893, 731, 343/853, 737; H01Q 1/38, 11/02, 21/00, 21/06, 21/08, 21/21, 21/22

[56] References Cited

U.S. PATENT DOCUMENTS 4,180,818 12/1979 Schwartz et al. ..... 343/700
4,347,516 8/1982 Shrekenhamer ..... 343/700
4,605,931 8/1986 Mead et al. ..... 343/700
4,654,668 3/1987 Schwartz et al. ..... 343/700 MS
4,963,892 10/1990 Matsuo et al. ..... 343/731

*Primary Examiner*—Michael C. Wimer
*Assistant Examiner*—Jhihan Clark
*Attorney, Agent, or Firm*—David L. Davis

[57] ABSTRACT

A space duplexed beamshaped microstrip antenna system including transmit and receive antennas, each of which has two groups of interleaved arrays. The array groups are slanted in opposite directions and each is fed from opposite corners of the antenna so that each group utilizes its entire assigned reduced width aperture to create the required beam contours for two beams. To achieve frequency and temperature compensation, one of the antennas is made up of forward firing arrays and the other of the antennas is made up of backward firing arrays.

6 Claims, 6 Drawing Sheets

SPACE DUPLEXED BEAMSHAPED MICROSTRIP ANTENNA SYSTEM

BACKGROUND OF THE INVENTION

This invention relates to Doppler radar navigation systems and, more particularly, to an improved transmit/receive antenna system for such a navigation system which is particularly well adapted for overwater use.

Antennas for overwater Doppler radar navigation systems must satisfy very stringent requirements. The type of antenna typically used for such an application is commonly referred to as a microstrip antenna and is formed as a planar printed circuit comprising an array of parallel lines of serially interconnected radiating rectangular patch elements. The antenna is mounted to the underbelly of an aircraft fuselage within a rectangular aperture formed by the ribs of the fuselage. Thus, the maximum size of the antenna is constrained by the spacing between the ribs. These Doppler antennas generate time shared beams within the defined aperture. Since beam width is inversely proportional to aperture size, one requirement is to utilize as much of the aperture as possible for each beam.

For Doppler systems that fly over both land and water, the navigation accuracy is impacted by a shift in the measured Doppler frequency due to the backscattering over water which is a function of the incidence angle (the angle from the vertical) and the actual sea state. The calmer the sea (the lower the sea state) the larger the Doppler error from land to sea because the sea has more of a mirror effect. It is therefore another requirement of such an antenna that it have the inherent ability to shape the beams so that they have contours which result in Doppler shifts which are essentially invariant with backscattering surface.

For FM/CW Doppler systems, the minimum required isolation between the transmit and receive antennas is sixty dB. This results in the requirement of space duplexed antennas (i.e., separate transmit and receive antennas). Since these antennas must both occupy the same aperture, this limits the full usage of the aperture for each of the antennas and conflicts with the requirement for narrow beam width.

Another requirement of such an antenna system is that it be inherently temperature and frequency compensated.

Planar microstrip antennas for Doppler radar navigation systems are well known. It is also known to slant the arrays in order to generate beams with particular contours to provide independence from overwater shift, as disclosed, for example, in U.S. Pat. No. 4,180,818, the contents of which are hereby incorporated by reference. U.S. Pat. No. 4,347,516, the contents of which are hereby incorporated by reference, discloses the application of the principles of the '818 patent to a rectangular antenna. However, the antenna according to the '516 patent only utilizes one half the available aperture for each of the beams. It is also known to interleave linear arrays so that the entire available aperture can be utilized for each beam and to use a crossover feed structure so that the antenna can be printed on only a single side of a substrate. Such structure is disclosed in U.S. Pat. No. 4,605,931, the contents of which are hereby incorporated by reference. However, the arrangement disclosed in the '931 patent provides all feeds from a single end of the antenna and only results in about half of the available aperture contributing to the shaping of each beam. When the width of an antenna employing the single-end feed scheme is reduced by half to accommodate a space duplexed configuration, the portion of the aperture contributing to beamshaping is also reduced by half. This reduced aperture is then unable to provide the degree of beam-shaping required for acceptable overwater performance.

It is therefore a primary object of the present invention to provide a transmit/receive antenna system satisfying all of the above requirements without the limitations of the known prior art.

SUMMARY OF THE INVENTION

The foregoing and additional objects are attained in accordance with the principles of this invention by providing separate transmit and receive antennas of the microstrip type which each occupy one half of the available aperture. Each of the antennas has two groups of slanted interleaved arrays, with each group being fed from opposite corners. Thus, each group of interleaved arrays utilizes its entire reduced width aperture to create the required beam contours for two beams. To insure that the composite transmit and receive beams are frequency and temperature compensated, one of the antennas is made up of forward firing arrays and the other of the antennas is made up of backward firing arrays.

In accordance with an aspect of this invention, each antenna has crossover feeds at both ends thereof.

In accordance with a further aspect of this invention, isolation between the transmit and receive antennas is enhanced by providing an elongated planar strip of conductive material on the radome surface between the transmit and receive antennas.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
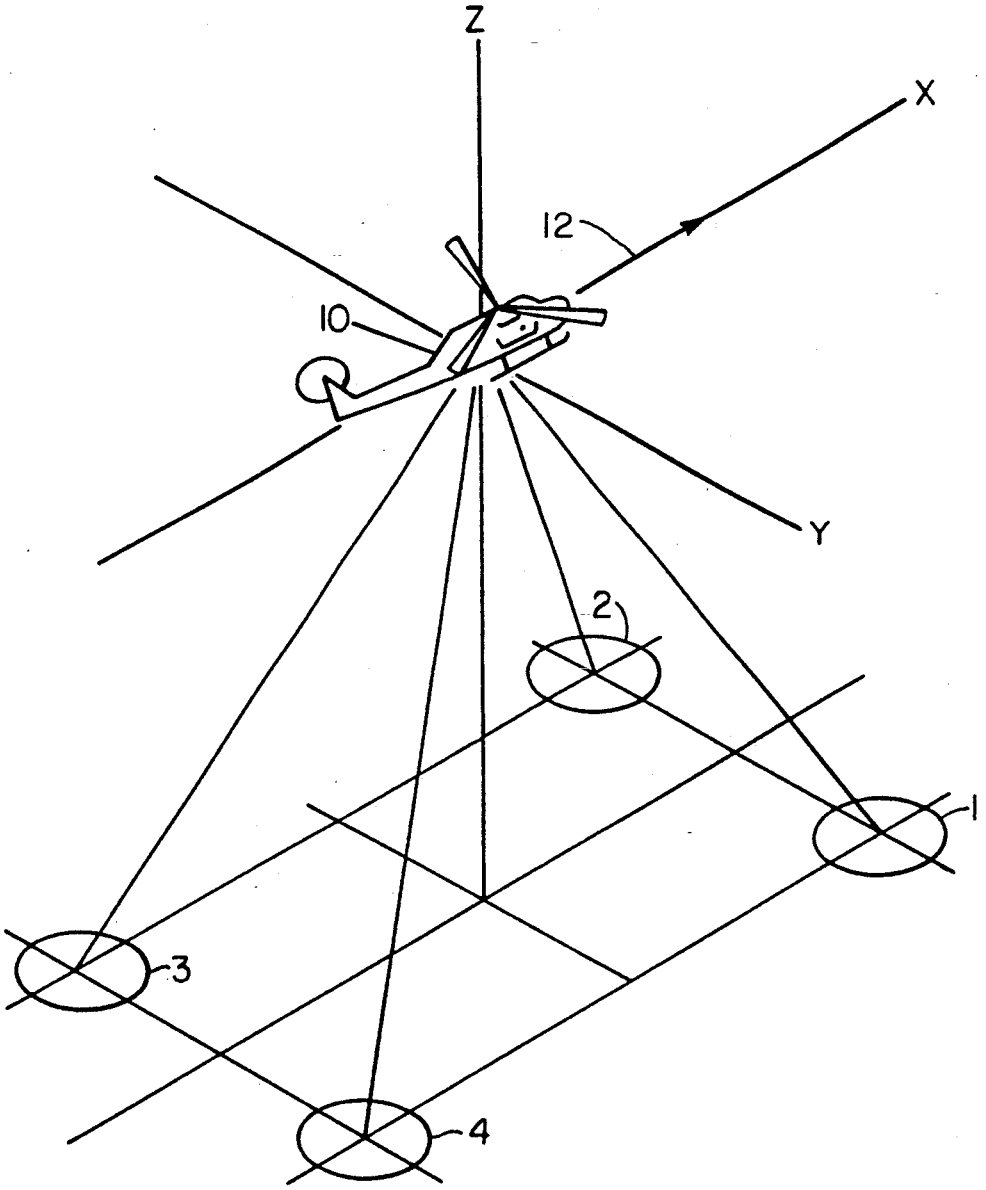
FIG. 1 illustrates four slanted beams radiated from a Doppler radar navigation system installed in a helicopter.

Referring now to the drawings, FIG. 1 illustrates an aircraft 10, illustratively a helicopter, which contains a Doppler radar navigation system. The fuselage of the aircraft 10 is constructed of a rectangularly intersecting pattern of ribs covered by a "skin". As is conventional, a planar microstrip antenna formed on a substrate is mounted in a rectangular aperture formed by the intersecting ribs in the underbelly of the aircraft 10. The antenna generates f our slanted beams, their intersections with the land or water over which the aircraft 10 is flying being designated 1, 2, 3 and 4. Thus, relative to the defined forward direction of travel of the aircraft 10 along the X-axis, the beams 1 and 2 are slanted in a forward direction and the beams 3 and 4 are slanted in a rearward direction. Further, the beams 1 and 4 are slanted toward the right and the beams 2 and 3 are slanted toward the left. It is understood that each of the beams is actually a composite beam made up of a transmitted beam radiated from the antenna and a reflected beam received, or absorbed, by the antenna.

Figure 2:
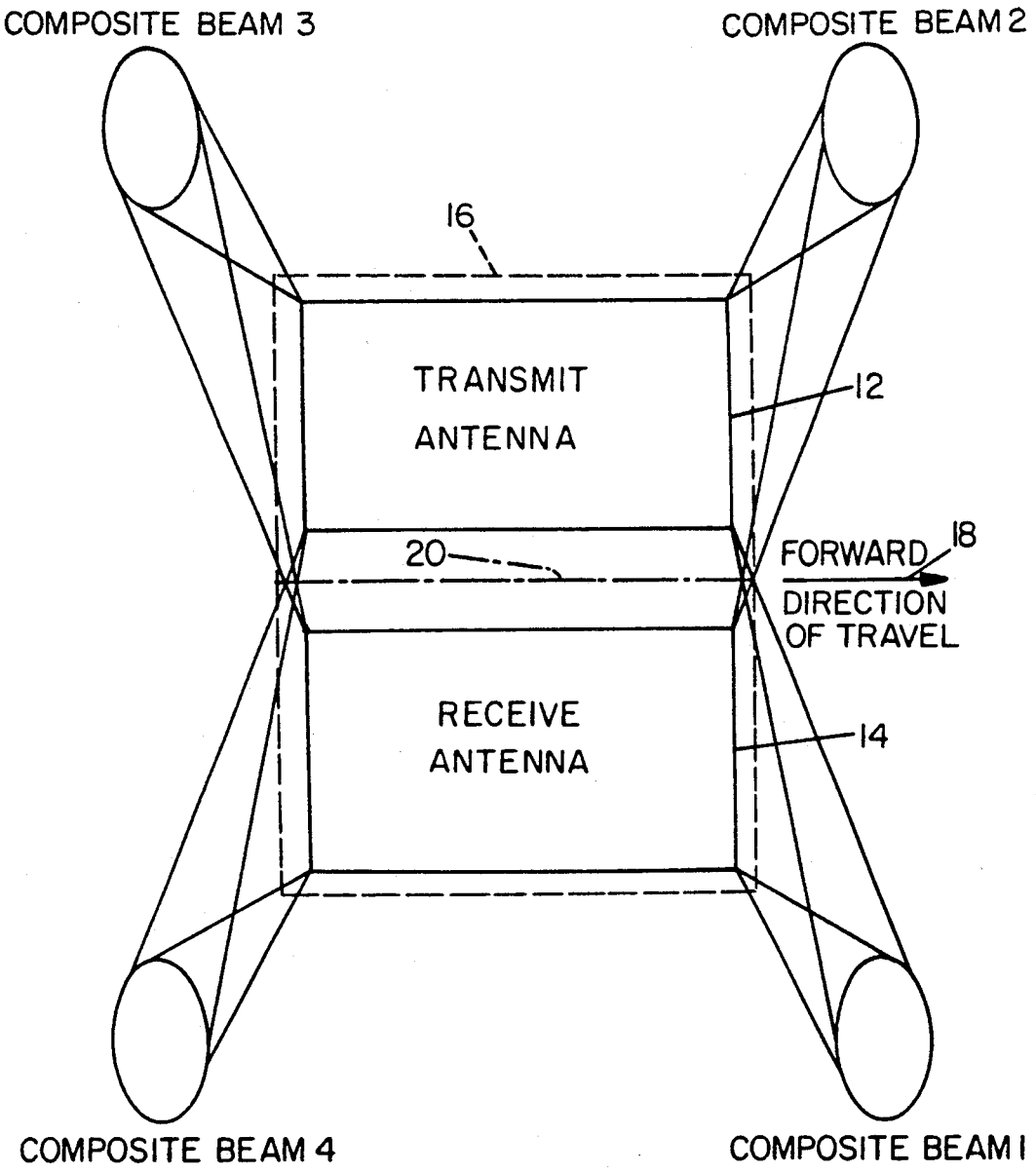
FIG. 2 schematically depicts a space duplexed antenna system for a Doppler radar navigation system which is useful for definition purposes.
Figure 3A:
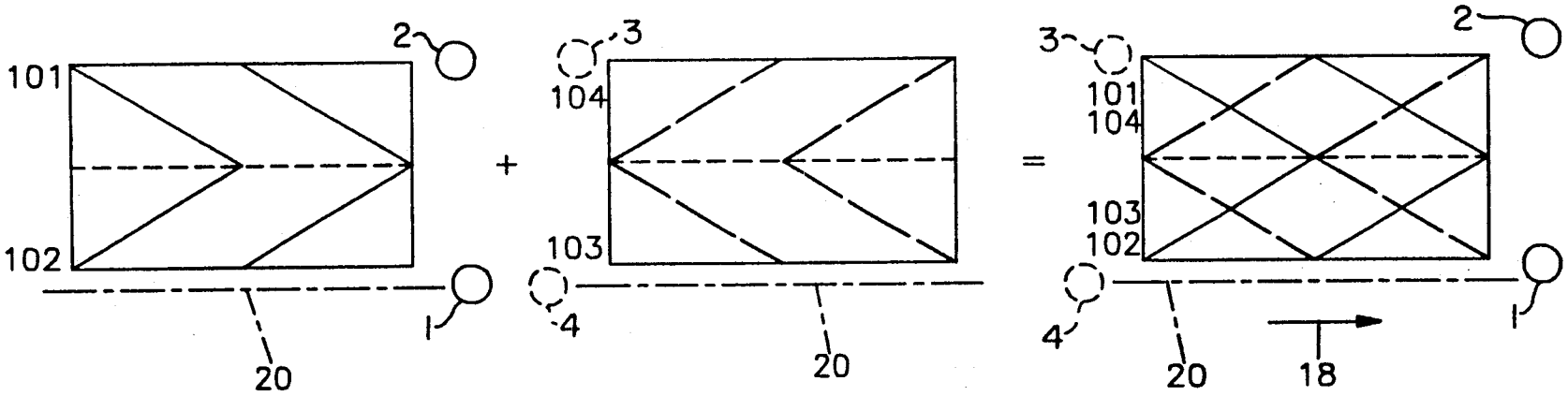
FIG. 3A illustrates the generation of four beams for one of the antennas of FIG. 2 in accordance with the prior art.

In a space duplexed antenna system, there are actually two separate antennas, one for the transmit function and one f or the receive function. As shown in FIG. 2, the transmit antenna 12 and the receive antenna 14 are side by side within a single rectangular aperture 16 (as delineated by the broken lines) formed by the rectangular rib pattern of the aircraft 10. The forward direction of travel of the aircraft 10 is shown by the arrow 18 and each of the antennas 12, 14 is on a respective side of the central axis 20 which bisects the aperture 16 and is parallel to the forward direction of travel 18. Thus, the transmit and receive antennas 12, 14 together generate composite beams 1, 2, 3 and 4, as shown in FIG. 2 and as understood in the art. However, each of the antennas 12, 14 can only utilize half of the total aperture 16 and therefore it is desirable that such usage be maximized. An object of the present invention is to combine the advantages of the space duplexed configuration with the beam shaped antenna. Initially, an attempt was made to use two side by side reduced width, crossover feed, single aperture antennas, each of the type disclosed in the referenced U.S. Pat. No. 4,605,931. By itself, when taking up an entire aperture, such an antenna has an overwater frequency shift of 0.2% or less. However, it was found that the reduction in width raised the overwater frequency shift to 0.8%, which is unacceptable. The reason for this is shown in FIG. 3A, which illustrates the generation of the four beams with such an antenna. It will be remembered that for a space duplexed configuration, this antenna only takes up one half of the total aperture. In FIG. 3A, the angled lines within the rectangular box indicate the slanting of the pattern of radiating patch elements of the antenna. Thus, the left box shown in FIG. 3A illustrates generation of the beam 1 by feeding from the corner 101 and generation of the beam 2 by feeding from the corner 102 through the use of forward firing arrays. It is seen that only one half of the antenna is used for shaping each of the beams, since the second half of the antenna when fed from each corner has the wrong slant. The middle box in FIG. 3A illustrates the generation of the beam 3 by feeding from the corner 103 and the generation of the beam 4 by feeding from the corner 104 by the use of backward firing arrays. When these arrays are interleaved, the composite structure shown in the right box of FIG. 3A is obtained, with all feeding being effected from one side of the antenna, as disclosed in the referenced U.S. Pat. No. 4,605,931. However, only one quarter of the total aperture is used to shape each beam in a space duplexed configuration, since each antenna takes up half the total aperture and half of each antenna is used for beam shaping. In this mode of operation, beam-shaping for acceptable overwater performance cannot be achieved.

Figure 3B:
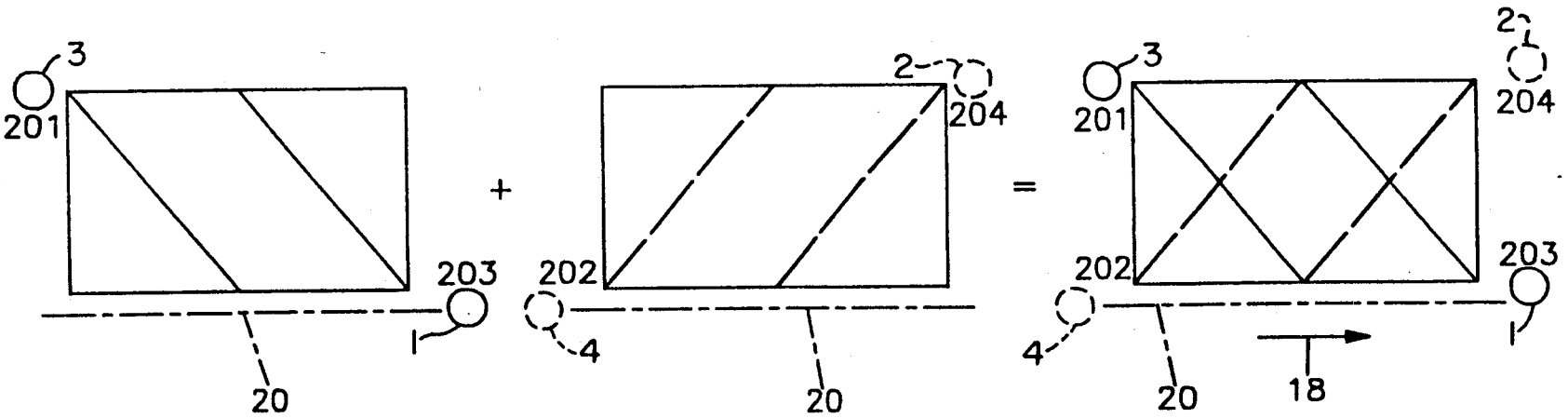
FIG. 3B illustrates the generation of four beams for one of the antennas of FIG. 2 in accordance with the present invention.

In accordance with the principles of this invention, adequate shaping for all four beams in the reduced width aperture is accomplished by using two groups of interleaved arrays and feeding each group from opposite corners. This is illustrated schematically in FIG. 3B. Thus, as shown in the left box in FIG. 3B, the beam 1 is generated by feeding the array group from the corner 201 and the beam 3 is generated by feeding the array group from the opposite corner 203. Thus, for this array group, the pattern of radiating elements is slanted forwardly toward the central axis 20. Interleaved with the array group of the left box in FIG. 3B is the array group shown in the middle box of FIG. 3B wherein the pattern of radiating elements is slanted forwardly away from the central axis 20. Thus, the beam 2 is generated by feeding that array group from the corner 202 and the beam 4 is generated by feeding the array group from the opposite corner 204. The two array groups are both forward firing arrays and their composite is shown in the right box of FIG. 3B. Using the scheme depicted in FIG. 3B, the entire reduced width aperture is utilized for shaping each beam. Computer simulation confirmed that an overwater frequency shift of 0.2% is obtained by such a scheme.

It is important to note that FIG. 3B only illustrates forward firing arrays. The inventive concept works equally as well with backward firing arrays but it is understood that within an antenna according to this invention, all of the arrays must be either forward firing or backward firing, with no intermixing being permitted. To implement this scheme, crossover feeds at both ends of the antenna are utilized. This configuration actually allows the generation of eight beams, but only four of these beams will be properly shaped so that the points at which the antenna is fed are chosen to energize the four properly shaped beams.

Figure 4:
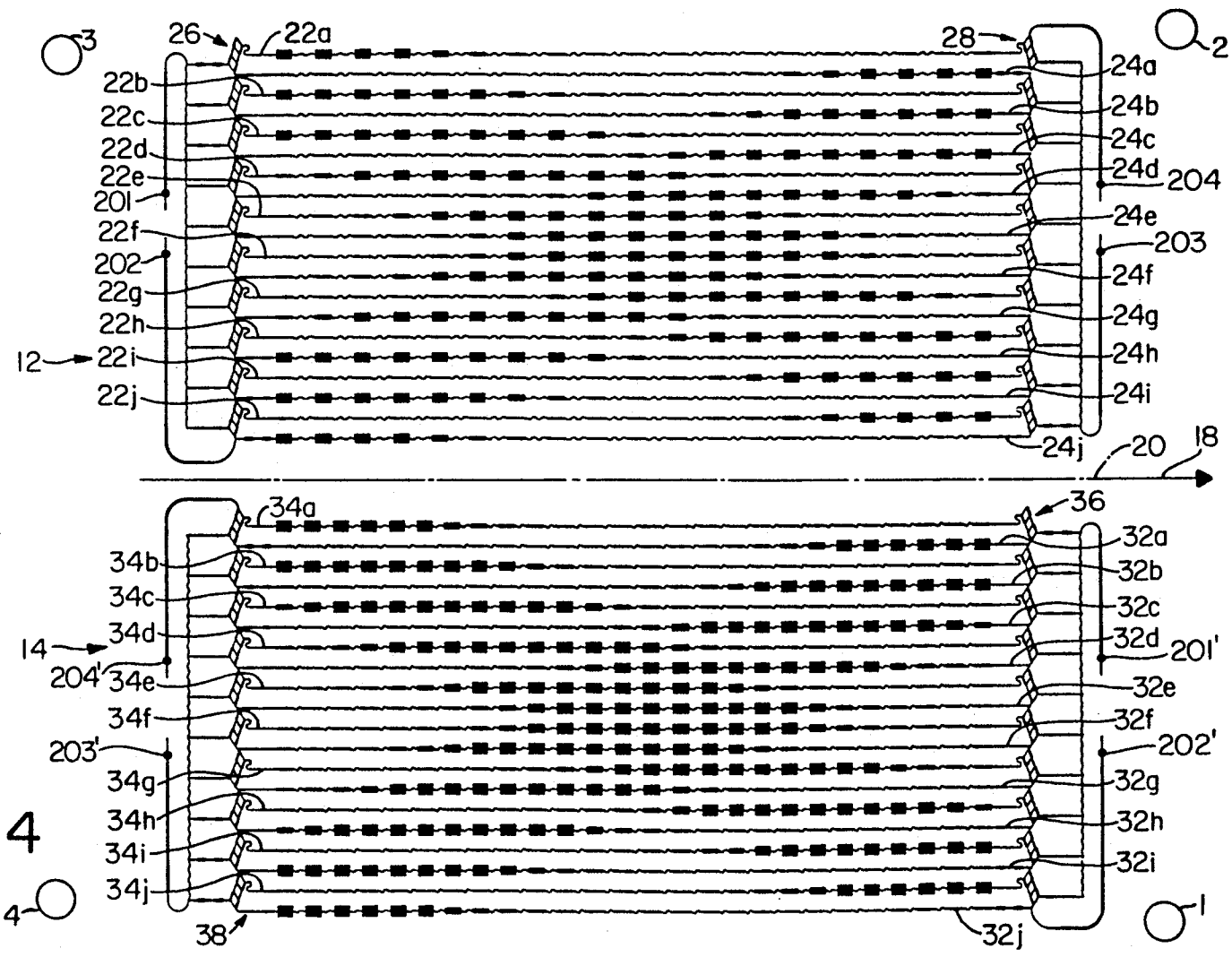
FIG. 4 is a plan view of the entire radiating plane of an illustrative embodiment of an antenna system constructed according to this invention.

FIG. 4 shows in detail an illustrative embodiment of a space duplexed planar microstrip antenna system constructed according to this invention. Thus, the antenna system shown in FIG. 4 includes a transmit antenna 12 and a receive antenna 14 spaced on opposite sides of the central axis 20.

The transmit antenna 12 is made up of a first array group which includes a first plurality of parallel lines *22a–22j* of serially interconnected radiating rectangular patch elements. The lines *22a–22j* are parallel to the central axis 20. It is readily apparent from FIG. 4 that the pattern of radiating elements in the lines of the first array group is slanted forwardly toward the central axis 20. The transmit antenna 12 further includes a second array group having a second plurality of parallel lines *24a–24j*, each of which comprises serially interconnected radiating rectangular patch elements. Like the first array group, the lines of the second array group are parallel to the central axis 20 but the pattern of radiating elements in the lines *24a–24j* is slanted forwardly away from the central axis 20. The lines *22a–22j* and the lines *24a–24j* are interleaved. At the two ends of all of the lines *22a–22j* and *24a–24j* there are provided respective crossover feed structures 26 and 28. When the crossover feed structure 26 is fed from the feed port 201, the radiating patch elements of the lines 22a–22j generate the beam 1. When the crossover feed structure 26 is fed from the feed port 202, the radiating patch elements of the lines 24a–24j generate the beam 2. When the crossover feed structure 28 is fed from the feed port 203, the radiating patch elements of the lines 22a–22j generate the beam 3. When the crossover feed structure 28 is fed from the feed port 204, the radiating patch elements of the lines 24a–24j generate the beam 4. The radiating patch elements of the two array groups are designed so that both of the array groups are forward firing.

On the other side of the central axis 20 is the receive antenna 14. The antenna 14 is made up of a third array group which includes a third plurality of parallel lines 32a–32j of serially interconnected radiating rectangular patch elements. The lines 32a–32j are parallel to the central axis 20. It is readily apparent from FIG. 4 that the pattern of radiating elements in the lines of the third array group is slanted forwardly toward the central axis 20. The receive antenna 14 further includes a fourth array group having a fourth plurality of parallel lines 34a–34j, each of which comprises serially interconnected radiating rectangular patch elements. Like the third array group, the lines of the fourth array group are parallel to the central axis 20 but the pattern of radiating elements in the lines 34a–34j is slanted forwardly away from the central axis 20. The lines 32a–32j and the lines 34a–34j are interleaved. At the two ends of the lines 32a–32j and 34a–34j there are provided respective crossover feed structures 36 and 38. When the crossover feed structure 36 is fed from the feed port 2011, the radiating patch elements of the lines 34a–34j generate the beam 1. When the crossover feed structure 36 is fed from the feed port 202', the radiating patch elements of the lines 32a–32j generate the beam 2. When the crossover feed structure 38 is fed from the feed port 203', the radiating patch elements of the lines 34a–34j generate the beam 3. When the crossover feed structure 38 is fed from the feed port 204', the radiating patch elements of the lines 32a–32j generate the beam 4. The radiating patch elements of the two array groups are designed so that both of the array groups are backward firing.

It is noted that each of the crossover feed structures 26, 28, 36 and 38 feeds its respective groups of lines from opposite corners of the end of the antenna with which it is associated. That is, for example, the crossover feed structure 26 feeds the lines 22a–22j from the upper left corner (when viewed in FIG. 4) and feeds the lines 24a–24j from the lower left corner (when viewed in FIG. 4).

Although the antenna system shown in FIG. 4 includes forward firing arrays for the transmit antenna 12 and backward firing arrays for the receive antenna 14, the same results are achieved if the transmit antenna is made up of backward firing arrays and the receive antenna is made up of forward firing arrays. However, in order that the composite beams be temperature and frequency compensated, the firing directions of the arrays for the transmit and receive antennas must be oppositely directed. Further, to minimize mutual coupling within each of the antennas 12, 14, the phasing within the lines 22a–22j is the same as the phasing within the lines 24a–24j, and the phasing within the lines 32a–32j is the same as the phasing within the lines 34a–34j.

Figure 5A:
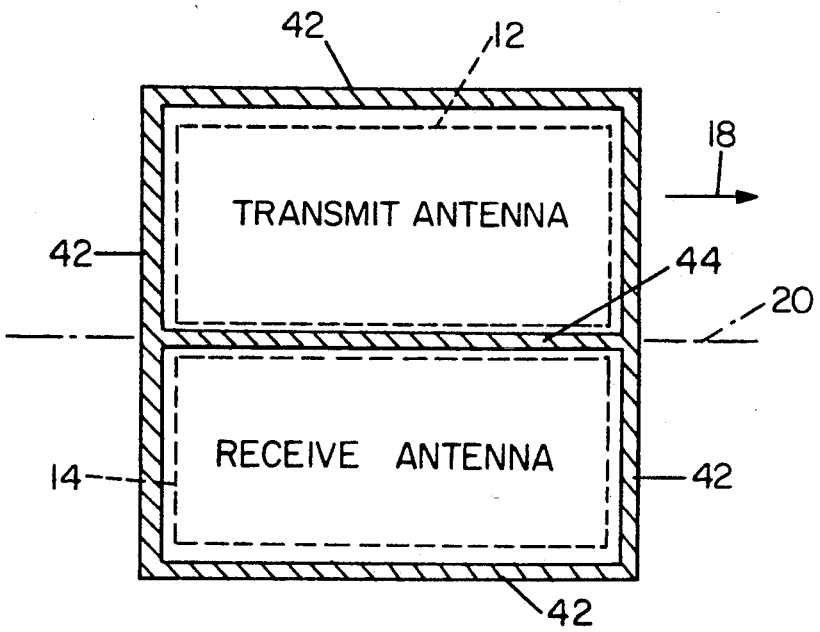
FIG. 5A illustrates how the isolation between the transmit and receive antennas is enhanced according to an aspect of this invention and FIG. 5B is a cross sectional view showing the layers of the antenna.
Figure 5B:
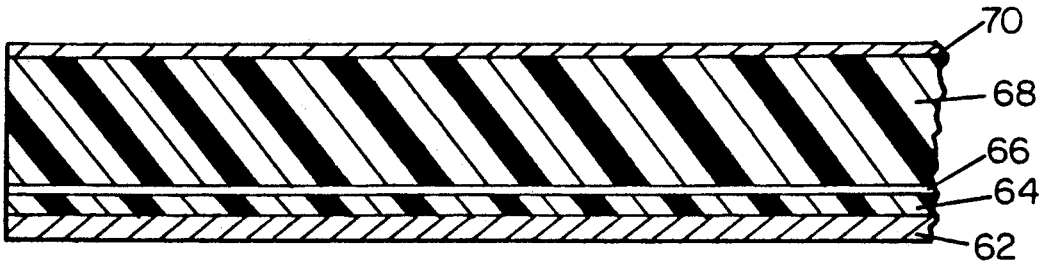

Referring to FIGS. 5A and 5B, to provide isolation the antennas 12 and 14 are typically provided with a shielding mask in the form of planar strips 42 of conductive material, on the radome and surrounding the antennas 12, 14. The radome is a planar nonconformal substitute for the aircraft "skin" to cover the aperture formed by the pattern of intersecting ribs where the antenna is installed. As shown in FIG. 5B, the antenna is made up of several layers, with the upper layer of FIG. 5B being the outer layer. In this illustrative embodiment, the layer 62 is the aluminum ground plane, of nominal thickness 0.030". The layer 64 is a dielectric substrate of nominal thickness 0.015". The layer 66 is the printed circuit making up the antenna shown in FIG. 4, of nominal thickness 0.0015". The layer 68 is a dielectric substrate making up the radome, of nominal thickness 0.095". The layer 70 is a printed circuit making up the mask shown in FIG. 5A, of nominal thickness 0.0015". In addition to the mask made up of the strips 42, according to this invention an additional strip 44 is provided. The strip 44 is separate from the antennas 12, 14 and lies in the plane of the strips 42 making up the mask, along the central axis 20 and between the antennas 12, 14. It has been found that the strip 44 enhances the isolation between the antennas 12 and 14 so that sixty dB of isolation can be attained.

For additional stability with respect to changes in temperature, it has been found that using Duroid 6002 material made by Rogers Corporation for the printed circuitry is preferred. The use of the temperature stable 6002 material requires modification of the crossover feeds 26, 28, 36 and 38 from that which is conventional. Besides allowing two microstrip lines to cross each other on the same substrate, the crossover feed controls the phasing and resultant angle of the sigma, or transverse, beam. Sigma beam angle is a function of the spacing between array lines and the electrical length of the line between them. The 6002 material has a higher dielectric constant than conventional PTFE (polytetrafluoroethylene) material (2.9 vs. 2.2), and as a result, the wavelength in the material is considerably shorter. While the physical length of the line between array lines is unchanged, its electrical length increases (the shorter wavelength means more wavelengths per inch of line), causing the sigma angle to change by several degrees. Since a certain minimum spacing between array lines is required for interleaving, the only way to correct the sigma angle is to shorten the electrical length of the line between arrays.

Figure 6A:
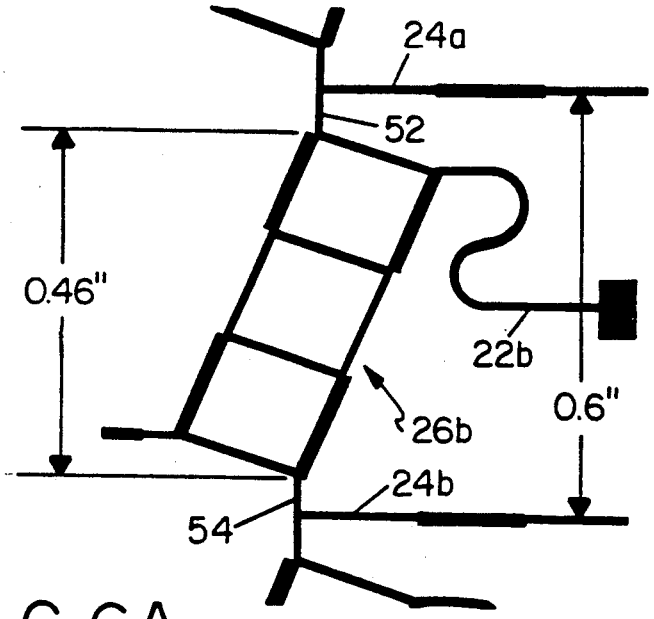
FIG. 6A is an enlarged detail of a portion of a crossover feed structure in accordance with the prior art and FIG. 6B is an enlarged detail of a portion of a crossover feed structure in accordance with an aspect of the present invention.
Figure 6B:
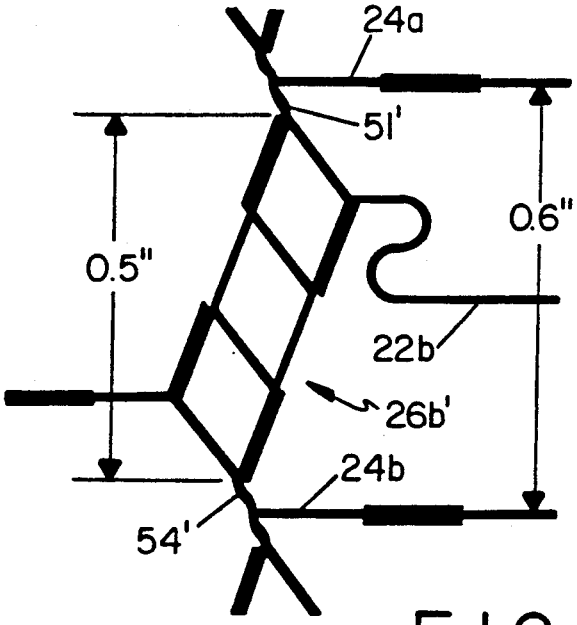

Referring to FIG. 6A, there is shown the four point branch-arm hybrid structure 26b of the crossover feed structure 26 which is connected between the lines 24a and 24b by the short interconnect lines 52 and 54. Using prior art techniques, with an interline spacing of 0.6 inches, the physical distance across the diagonal of the hybrid structure 26b is 0.46 inches. Since the dimensions of the hybrid structure are fixed for a given material, the only way to reduce electrical length is to shorten the interconnects 52, 54. However, it will be noticed from FIG. 6A that the interconnects 52, 54 are straight and therefore cannot be shortened. FIG. 6B illustrates a solution to this problem in accordance with an aspect of this invention. The hybrid structure 26b' has been made into a parallelogram shape rather than a rectangular shape so that it has a greater corner-to-corner distance (i.e., 0.5 inches) and can therefore span a greater physical distance. This allows the interconnects 52', 54' to be made shorter, thereby reducing electrical length. While the "squinted" crossover of FIG. 6B spans a greater physical distance than the rectangular crossover of FIG. 6A, the electrical length from corner to corner is the same for both. The overall electrical length between array lines is therefore reduced, bringing the sigma beam back to its proper angle.

Accordingly, there has been disclosed an improved space duplexed beamshaped microstrip antenna system. While an illustrative embodiment of the present invention has been disclosed herein, it is understood that various modifications and adaptations to the disclosed embodiment will be apparent to those of ordinary skill in the art and it is only intended that this invention be limited by the scope of the appended claims.

We claim:

1. A planar microstrip antenna system for a Doppler radar navigation system of a vehicle having separate space duplexed arrays of radiating patch elements for the transmit and receive functions and which is compensated for temperature, frequency and overwater shifts, said antenna system filling a defined rectangular aperture having a central axis parallel to the defined forward direction of travel of the vehicle and bisecting the aperture, said antenna system comprising:

a transmit antenna on a first side of said central axis, said transmit antenna including:

a) a first array group including a first plurality of parallel lines of serially interconnected radiating rectangular patch elements wherein the first plurality of lines are parallel to the central axis and the pattern of radiating elements in the first plurality of lines is slanted forwardly toward the central axis;

b) a second array group including a second plurality of parallel lines of serially interconnected radiating rectangular patch elements wherein the second plurality of lines are parallel to the central axis and the pattern of radiating elements in the second plurality of lines is slanted forwardly away from the central axis, the second plurality of lines of said second array group being interleaved with the first plurality of lines of said first array group;

c) means for feeding said first and second array groups from a first end of said transmit antenna to generate a pair of forwardly directed beams; and d) means for feeding said first and second array groups from a second end of said transmit antenna to generate a pair of rearwardly directed beams; and a receive antenna on the other side of said central axis, said receive antenna including;

e) a third array group including a third plurality of parallel lines of serially interconnected radiating rectangular patch elements wherein the third plurality of lines are parallel to the central axis and the pattern of radiating elements in the third plurality of lines is slanted forwardly toward the central axis;

f) a fourth array group including a fourth plurality of parallel lines of serially interconnected radiating rectangular patch elements wherein the fourth plurality of lines are parallel to the central axis and the pattern of radiating elements in the fourth plurality of lines is slanted forwardly away from the central axis, the fourth plurality of lines of said fourth array group being interleaved with the third plurality of lines of said third array group;

g) means for feeding said third and fourth array groups from a first end of said receive antenna to generate a pair of forwardly directed beams; and h) means for feeding said third and fourth array groups from a second end of said receive antenna to generate a pair of rearwardly directed beams; and wherein one of said transmit and receive antennas is made up of forward firing array groups and the other of said transmit and receive antennas is made up of backward firing array groups.

2. The antenna system according to claim 1 further comprising an elongated planar strip of conductive material separate from said transmit and receive antennas, said strip lying on the radome along said central axis and between said transmit and receive antennas.

3. The antenna system according to claim 1 wherein each of said feeding means includes a respective crossover feed structure.

4. The antenna system according to claim 3 wherein each of said crossover feed structures feeds its respective array groups from opposite corners of the respective end of the associated antenna.

5. The antenna system according to claim 4 wherein each of said crossover feed structures includes a four port branch-arm hybrid structure connected by short interconnect lines between a pair of adjacent lines of radiating elements within an array group, said hybrid structure being so arranged that the total electrical length between said pair of adjacent lines for a predetermined spacing between said pair of adjacent lines is maintained at a predetermined electrical length for a specific dielectric constant of conductive material making up the antenna by controlling the length of the diagonal of the hybrid structure so that the length of the interconnect lines can be adjusted.

6. The antenna system according to claim 1 wherein said first array group is phased the same as said second array group, and said third array group is phased the same as said fourth array group, whereby mutual coupling between interleaved array groups within each of said transmit and receive antennas is minimized.

* * * * *